US006736189B2

(12) United States Patent
Bergmans et al.

(10) Patent No.: US 6,736,189 B2
(45) Date of Patent: May 18, 2004

(54) GUIDE SEGMENT FITTED WITH ROLLERS ON A CONTINUOUS CASTING INSTALLATION

(75) Inventors: Erich Bergmans, Oberhausen (DE); Gerhard Grelewitz, Rheinberg (DE); Walter Krume, Rheinberg (DE)

(73) Assignee: ThyssenKrupp Stahl AG, Duisburg (DE)

( * ) Notice: Subject to any disclaimer, the term of this patent is extended or adjusted under 35 U.S.C. 154(b) by 0 days.

(21) Appl. No.: 10/182,283

(22) PCT Filed: Jan. 24, 2001

(86) PCT No.: PCT/EP01/00760

§ 371 (c)(1),
(2), (4) Date: Sep. 27, 2002

(87) PCT Pub. No.: WO01/56724

PCT Pub. Date: Aug. 9, 2001

(65) Prior Publication Data

US 2003/0075302 A1 Apr. 24, 2003

(30) Foreign Application Priority Data

Jan. 31, 2000 (DE) ..... 100 03 846

(51) Int. Cl.[7] ..... B22D 11/00
(52) U.S. Cl. ..... 164/442; 164/448
(58) Field of Search ..... 164/441, 442, 164/448

(56) References Cited

U.S. PATENT DOCUMENTS 4,000,553 A 1/1977 Spannlang et al.
4,137,963 A * 2/1979 Langer et al. ..... 164/448
4,222,433 A 9/1980 Marti et al.
4,351,383 A * 9/1982 Gladwin ..... 164/448
5,649,889 A * 7/1997 Warner, III ..... 492/16
6,484,793 B1 * 11/2002 Scheurecker ..... 164/448

FOREIGN PATENT DOCUMENTS

FR 2 818 336 * 12/2001

* cited by examiner

*Primary Examiner*—Kiley Stoner
*Assistant Examiner*—Len Tran
(74) *Attorney, Agent, or Firm*—Proskauer Rose LLP

(57) ABSTRACT

The invention relates to a guide segment fitted with rollers on a continuous casting installation. In order to be able to accommodate as high mechanical loads as possible so as to accommodate the supporting force, at least some rollers are split up into three axially aligned roller bodies (4*a*, 5, 6). Only the outer roller bodies (4, 6) are axially fixed by means of their outer bearings designed as fixed bearings, whereas the middle roller body (5) is mounted in a floating manner. All the inner bearings (4*b*, 6*a*) of the outer roller bodies (4, 6) designed as movable bearings and the two bearings (8*b*, 9*a*) of the middle roller body are designed as movable bearings with high loading capacity, in particular as CARB bearings. The free axial mobility of the middle roller body (5) mounted in a floating manner is limited by stops (11, 12*a*, 12*b*, 13) designed as butting discs arranged between the end faces of the middle roller body (5) and the outer roller bodies (4, 6) lying opposite one another.

5 Claims, 3 Drawing Sheets

GUIDE SEGMENT FITTED WITH ROLLERS ON A CONTINUOUS CASTING INSTALLATION

BACKGROUND OF THE INVENTION

The invention relates to a guide segment fitted with rollers on a continuous casting installation, whereby at least some rollers each comprise at least two aligned roller bodies mounted with end roller pivots in inner and outer bearings, whereby the inner bearings are designed as movable bearings in the form of cageless heavy-duty bearings and the outer bearings are designed as fixed bearings.

Guide segments fitted with rollers on continuous casting installations serve to transfer the band-shaped cord emerging from the casting die with still liquid core through an arc from the vertical into the horizontal. The mechanical load on the roller seating thereby arising is great, above all on the outer arc of the guide. It is customary, therefore, not to fit the guide-segments with one-piece rollers extending over the whole cord width, but rather with multi-piece rollers, especially with two aligned roller bodies. Since on the one hand the rollers have to be mounted so as to be axially fixed, and on the other hand fixed bearings, which perform this task, withstand a lower mechanical load than cageless heavy-duty bearings obtainable only in the form of movable bearings, such as for example CARB bearings from the firm SKF, the fitting of guide segments with rollers has in recent times undergone a switch to the use of two aligned roller bodies per roller in each case, the outer bearings of which are designed as fixed bearings and the inner bearings of which are designed as movable bearings in the form of cageless CARB bearings. With the design of the inner bearings as special movable bearings, the higher loading of the roller by the cord in the area of the cord centre is taken into account.

In the areas of the arc-shaped guide subject to particularly great mechanical stress, especially at the outer arc, two aligned roller bodies per roller are not sufficient as a support for the cord, especially in the case of relatively wide cords. For this reason, three roller bodies per roller aligned with one another have in the past been used in these areas. However, since the cageless heavy-duty bearings capable of greater mechanical loads withstand only a limited axial relative displacement of their ball races and therefore, with two roller bodies arranged aligned, each roller body is fixed axially at one end with a fixed bearing, the application of the bearing principle "one fixed and one movable bearing per roller body" for the middle roller body would not lead, on account of the lower loading capacity of the fixed bearing, to the desired successful outcome of an overall higher loading capacity of the roller.

SUMMARY OF THE INVENTION

The problem underlying the invention is to provide a guide segment fitted with rollers on a continuous casting installation, said guide segment being capable of withstanding higher mechanical loads than a guide segment with two roller bodies per roller in each case.

According to the invention, this problem is solved with a guide segment of the kind mentioned at the outset by the fact that, between the two roller bodies and aligned therewith, a further roller body is mounted axially floating with its two end roller pivots in movable bearings in the form of cageless heavy-duty bearings, whereby the free axial mobility of the middle roller body is limited by stops acting between the inner roller pivots of the outer roller bodies and the two roller pivots of the middle roller body.

In the case of the guide segment according to the invention, the higher loading capacity of the at least three-piece roller is achieved by the fact that, in the central support area of the cord, where the roller must apply the greatest supporting force, only the cageless movable bearings capable of withstanding high loads are used. The so-called CARB bearings from the firm SKF, which are available on the market, currently come into consideration for this. It is conceivable, however, for other movable bearings comparable in loading capacity to be used. The limited permissible axial mobility for these movable bearings is limited solely by the outer fixed bearings of the outer roller bodies. In the case of the outer roller bodies this takes place directly via their outer fixed bearings and in the case of the middle roller body via the stops on the axially fixed outer roller bodies.

As known per se, the fixed bearings are preferably self-aligning roller bearings.

The axial mobility of the middle roller body can be limited in terms of construction by the fact that the two inner roller pivots of the outer roller bodies and/or the roller pivots of the middle roller body have on their end faces butting discs which limit the axial play of the middle roller body in such a way that, in the cold state of the roller bodies, it is $\leqq$ the permitted axial mobility of the movable bearings of the middle roller body and > than the sum of the maximum axial heat expansion of the roller bodies.

In order to have the rollers mounted in the optimum fashion at operating temperature, provision is made according to a development of the invention such that the bearing rings of the movable bearings of the outer roller bodies are axially offset with respect to one another in their cold state in such a way that they are in their optimum bearing position in the operational hot state.

BRIEF DESCRIPTION OF THE DRAWINGS

The invention will be explained below in greater detail with the aid of a drawing representing an example of embodiment. The figures show the following.

DETAILED DESCRIPTION OF THE INVENTION

Figure 1:
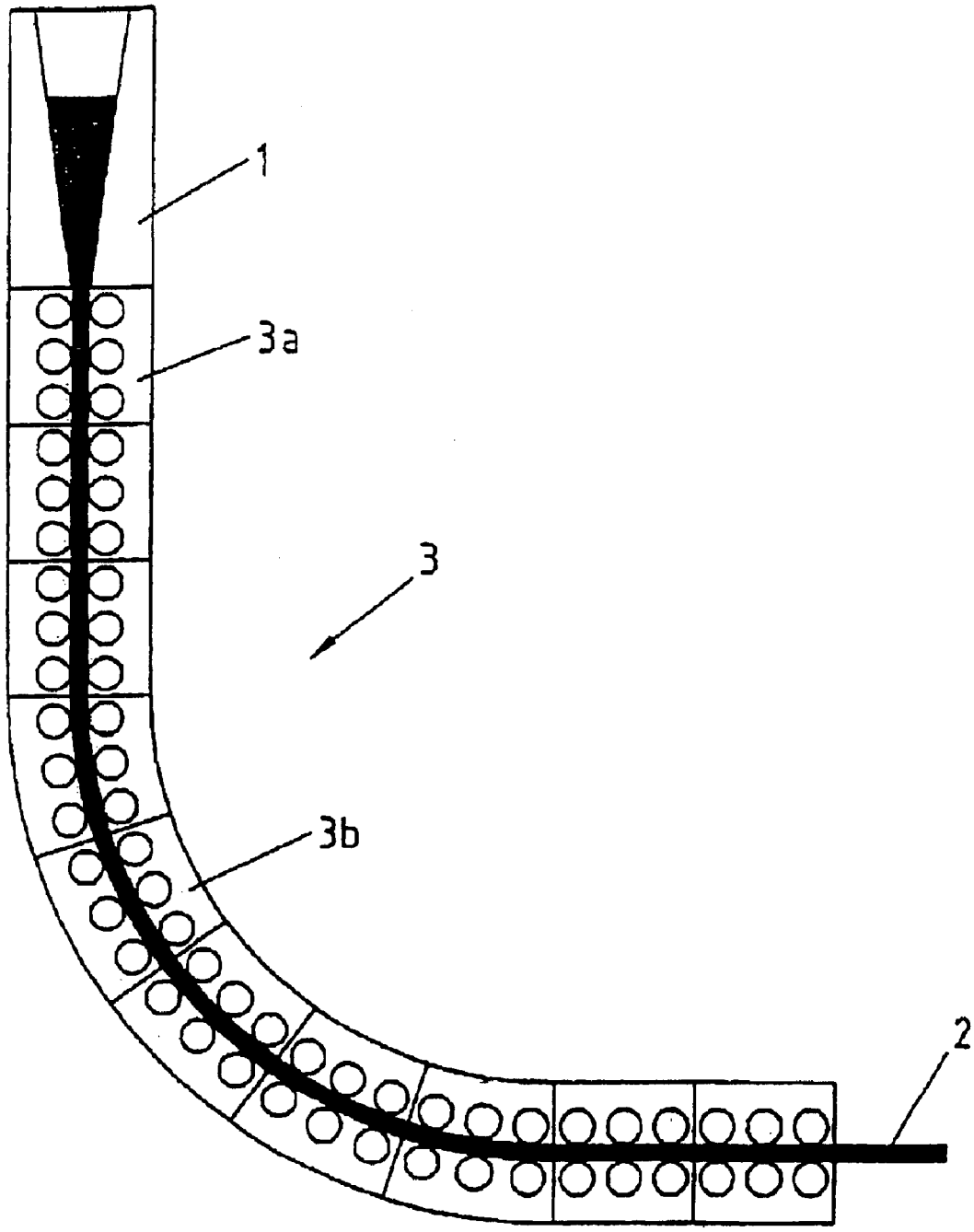
FIG. 1 a continuous casting installation in diagrammatic side view with casting die and arc-shaped cord guide formed by guide segments, FIG. 2 a roller in axial section consisting of three roller bodies mounted in a segment and FIG. 3 the left-hand outer roller body of the roller with bearings according to FIG. 2 in axial section in enlarged representation.

In the continuous casting installation according to FIG. 1, a band-shaped cord 2 poured in a casting die 1 is deflected from the vertical into the horizontal with an arc-shaped guide 3 formed by guide segments 3*a*, 3*b*. Individual guide segments 3*a*, 3*b* support cord 2 on its wide faces with rollers. The rollers must apply the greatest supporting force in the central area of the cord. One of these rollers, for example one of the rollers arranged on the outer arc of arc-shaped guide 3, is represented in detail in FIG. 2.

Figure 2:
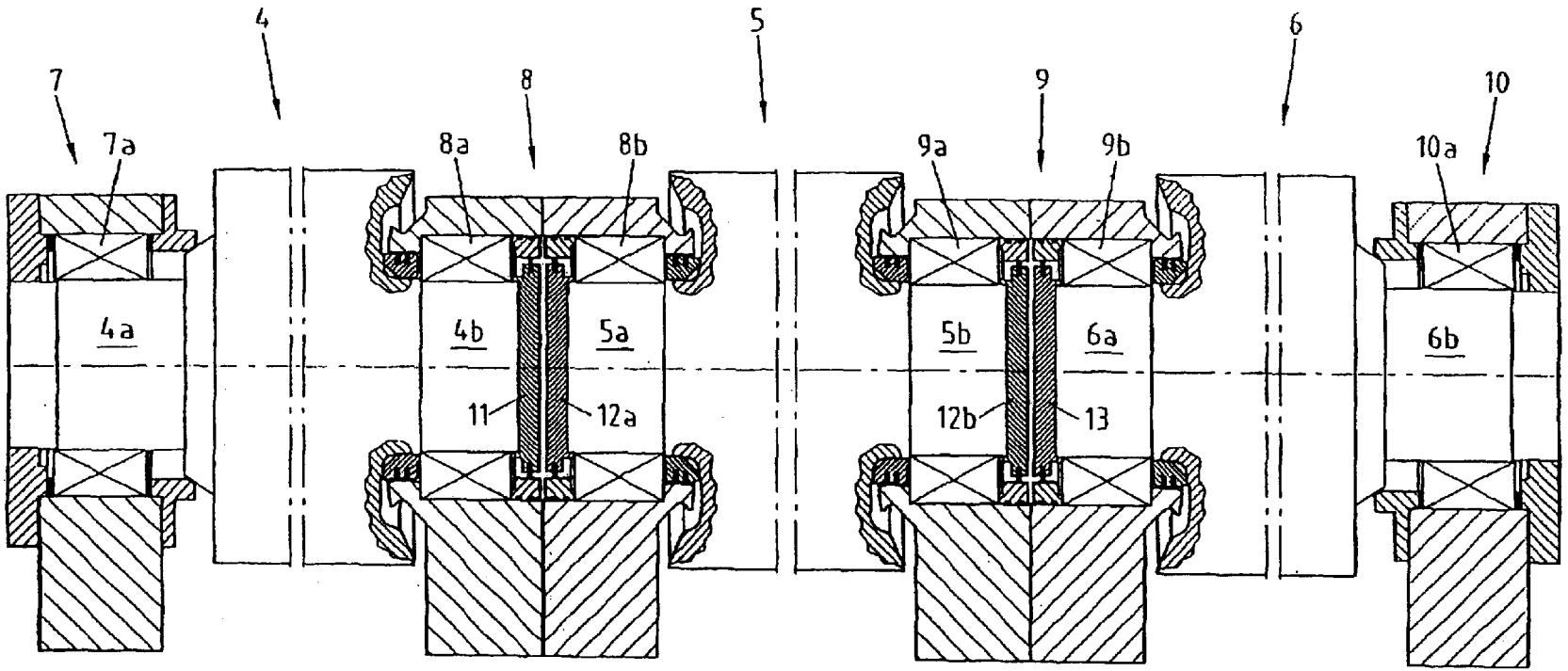

The roller according to FIG. 2 comprises three roller bodies 4, 5, 6 arranged aligned, which in each case are mounted with end roller pivots 4*a*, 4*b*, 5*a*, 5*b*, 6*a*, 6*b* in rolling bearings 7*a*, 8*a*, 8*b*, 9*a*, 9*b*, 10*a*, which are carried by bearing blocks 7, 8, 9, 10 of guide segment 3*b*. Outer bearings 7*a*, 10*a* of the two outer roller bodies 4, 6 are designed as fixed bearings, whilst all the other bearings 8*a*, 8*b*, 9*a*, 9*b* are designed as movable bearings.

Both fixed bearings 7*a*, 10*a* are conventional self-aligning roller bearings, by means of which bearing pivots 4*a*, 6*b* are axially fixed with respect to their bearing blocks 7, 10 in the guide segment. All the other bearings 8*a*, 8*b*, 9*a*, 9*b* are designed as special movable bearings capable of withstanding high loads. In particular, cageless roller bearings with slightly cambered rolls are suitable, which with comparatively high loading capacity are in a position to compensate for inclined positions and axial displacement. CARB bearings from the firm SKF, for example, currently meet these quality requirements. With movable bearings 8*a*, 8*b*, 9*a*, 9*b* of the example of embodiment, the inner bearing ring on roller pivot 4*b*, 5*a*, 5*b*, 6*a* can thus be axially displaced or in an inclined position with respect to the outer bearing ring fixed in bearing block 8, 9.

Since middle roller body 5 is mounted with both roller pivots 5*a*, 5*b* in movable bearings 8*b*, 9*a*, a floating bearing results for roller body 5. The axial mobility of this roller body 5 mounted in a floating manner must be limited so that movable bearings 8*b*, 9*a* do not become overloaded by excessively large axial displacement. For this purpose, the end faces of bearing pivots 4*a*, 5*a*, 5*b*, 6*a* facing one another have bolted-on butting discs 11, 12*a*, 12*b*, 13. The initial state with cold roller bodies 4, 5, 6 is shown in the drawing. As can be seen, butting discs 11, 12*a*, 12*b*, 13 facing one another have a certain axial spacing with respect to one another. This is dimensioned so that roller body 5 mounted in a floating manner can be displaced into one or other axial direction only by a path which is at most equal to the maximum permissible axial displacement for its movable bearings. It is however sufficiently large to be able to accommodate the maximum expected axial displacement of roller bodies 4, 5, 6 with their roller pivots 4*a*, 5*a*, 5*b*, 6*b* as result of thermal expansions. It goes without saying that, by means of targeted cooling of the roller bodies, their thermal expansion can be influenced, in particular kept within certain limits.

Figure 3:
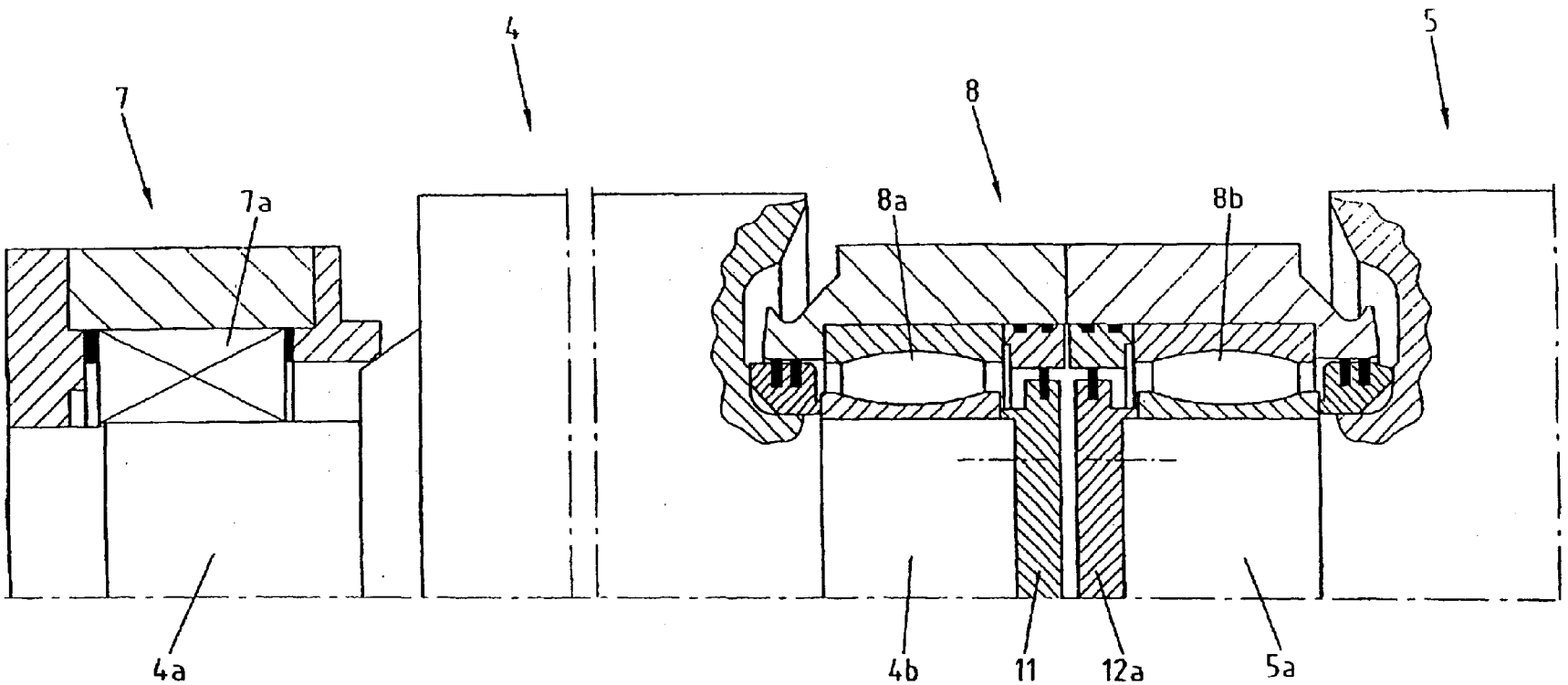

It can further be seen from the representation of FIG. 3, which shows the installation situation of roller bodies 4, 5, 6 in the cold state, that the bearing rings of inner movable bearing 8*a* of outer roller body 4 are axially offset by a certain amount with respect to one another. A corresponding axial offset is provided in the case of the bearing rings of movable bearing 9*b* of the other roller body 6 (not shown in FIG. 3). This axial offset is dimensioned so that the bearing rings of movable bearings 8*a*, 9*b* are in their optimum bearing position with respect to one another when roller bodies 4, 6 are at operating heat.

What is claimed is:

1. A guide segment having rollers for a continuous casting installation, wherein at least some of the rollers comprise:

first and second axially aligned outer roller bodies each of which is mounted with inner and outer end roller pivots in inner and outer bearings, each of said inner bearings being a movable bearing configured as a cageless heavy duty bearing, each of said outer bearings being a fixed bearing, at least one middle roller body disposed between and axially aligned with said first and second outer roller bodies, said middle roller body being mounted with end roller pivots in movable bearings on both sides of said middle roller body, said movable bearings of said middle roller body being configured as cageless heavy duty bearings to permit free axial movement of said middle roller body, and stops for limiting the free axial movement of said middle roller body disposed between the inner end roller pivots of said outer roller bodies and the end roller pivots of said middle roller body.

2. The guide segment of claim 1 wherein said fixed bearings of said outer roller bodies are configured as self-aligning roller bearings.

3. The guide segment of claim 1 wherein the stops are configured as butting discs which limit the axial movement of said middle roller body such that in a cold state of the roller bodies, the free axial movement is less than or equal to the permitted axial movement of the movable bearings of the middle roller body, and greater than the sum of the maximum axial heat expansions of the roller bodies.

4. The guide segment of claim 3 wherein the stops are configured as butting discs disposed on end faces of the end roller pivots of the middle roller body, or on end faces of the inner roller pivots of the first and second outer roller bodies.

5. The guide segment of claim 1 wherein the rollers further comprise bearing rings for the movable bearings of the outer roller bodies which are axially offset with respect to one another in a cold state of said roller bodies, and such that said bearing rings assume an optimum bearing position when said roller bodies are in a hot state.

* * * * *